US010577909B2

(12) United States Patent
Walters et al.

(10) Patent No.: US 10,577,909 B2
(45) Date of Patent: Mar. 3, 2020

(54) REAL-TIME, CONTINUOUS-FLOW PRESSURE DIAGNOSTICS FOR ANALYZING AND DESIGNING DIVERSION CYCLES OF FRACTURING OPERATIONS

(71) Applicant: Halliburton Energy Services, Inc., Houston, TX (US)

(72) Inventors: Harold Grayson Walters, Tomball, TX (US); Neil Alan Stegent, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 184 days.

(21) Appl. No.: 15/740,315

(22) PCT Filed: Nov. 10, 2015

(86) PCT No.: PCT/US2015/060005
§ 371 (c)(1),
(2) Date: Dec. 27, 2017

(87) PCT Pub. No.: WO2017/003501
PCT Pub. Date: Jan. 5, 2017

(65) Prior Publication Data

US 2018/0187538 A1 Jul. 5, 2018

Related U.S. Application Data

(60) Provisional application No. 62/186,812, filed on Jun. 30, 2015.

(51) Int. Cl.
*E21B 43/26* (2006.01)
*E21B 43/267* (2006.01)
(Continued)

(52) U.S. Cl.
CPC ..... *E21B 43/26* (2013.01); *E21B 43/267* (2013.01); *E21B 47/06* (2013.01); *E21B 43/14* (2013.01)

(58) Field of Classification Search
CPC ..... E21B 43/26; E21B 43/267; E21B 47/06
See application file for complete search history.

(56) References Cited

U.S. PATENT DOCUMENTS 2,859,819 A * 11/1958 Trott ..... E21B 43/26 166/308.1
4,393,933 A * 7/1983 Nolte ..... E21B 43/26 166/250.1
(Continued)

FOREIGN PATENT DOCUMENTS

CA 3041239 A1 * 7/2018 ..... E21B 43/267

OTHER PUBLICATIONS

Hyden, et al., Pump-In/Shutdown Tests Key to Finding Near-Wellbore Restrictions, Permian Basin Oil and Gas Recovery Conference, Midland, TX 1996, SPE 35194.
(Continued)

*Primary Examiner* — Jennifer H Gay
(74) *Attorney, Agent, or Firm* — McGuireWoods LLP

(57) ABSTRACT

Fracturing operations that include fluid diversion cycles may include real-time, continuous-flow pressure diagnostics to analyze and design the fluid diversion cycles of fracturing operations. The real-time, continuous-flow pressure diagnostics are injection rate step cycles that may include open low injection rate step cycles, propped low injection rate step cycles, diverted low injection rate cycles, and high injection rate cycles.

18 Claims, 9 Drawing Sheets

(51) Int. Cl.
*E21B 47/06* (2012.01)
*E21B 43/14* (2006.01)

(56) References Cited

U.S. PATENT DOCUMENTS

| | | | | |
|---|---|---|---|---|
| 4,836,280 | A * | 6/1989 | Soliman | E21B 43/26 166/250.1 |
| 5,482,116 | A * | 1/1996 | El-Rabaa | E21B 43/26 166/250.1 |
| 5,597,043 | A * | 1/1997 | Stadulis | E21B 33/13 166/280.1 |
| 5,875,843 | A * | 3/1999 | Hill | E21B 43/26 166/250.1 |
| 7,681,635 | B2 | 3/2010 | Farabee et al. | |
| 9,574,443 | B2 * | 2/2017 | Walters | E21B 49/008 |
| 9,702,247 | B2 * | 7/2017 | Walters | E21B 49/008 |
| 10,378,333 | B2 * | 8/2019 | Dawson | E21B 7/06 |
| 2011/0048719 | A1 | 3/2011 | Baihly et al. | |
| 2013/0048282 | A1 | 2/2013 | Adams et al. | |
| 2013/0105157 | A1 * | 5/2013 | Barmatov | C09K 8/685 166/280.1 |
| 2013/0284438 | A1 | 10/2013 | Dusseault et al. | |
| 2013/0341030 | A1 * | 12/2013 | Brannon | C09K 8/60 166/308.2 |
| 2014/0014338 | A1 * | 1/2014 | Crews | E21B 43/26 166/280.1 |
| 2014/0182841 | A1 * | 7/2014 | Lecerf | E21B 43/25 166/250.01 |
| 2014/0278316 | A1 * | 9/2014 | Dusterhoft | E21B 43/26 703/10 |
| 2015/0075777 | A1 * | 3/2015 | Walters | E21B 49/008 166/250.1 |
| 2015/0075778 | A1 * | 3/2015 | Walters | E21B 49/008 166/250.1 |
| 2015/0075779 | A1 * | 3/2015 | Walters | E21B 49/008 166/250.1 |
| 2016/0177693 | A1 * | 6/2016 | Gomaa | E21B 43/267 166/250.07 |
| 2016/0230526 | A1 * | 8/2016 | Crews | E21B 43/17 |
| 2016/0280983 | A1 * | 9/2016 | Zamora | C09K 8/514 |
| 2016/0298437 | A1 * | 10/2016 | Mendell | E21B 43/26 |
| 2016/0312573 | A1 * | 10/2016 | Kraemer | E21B 43/26 |
| 2018/0127644 | A1 * | 5/2018 | Xiang | C09K 8/66 |
| 2018/0187538 | A1 * | 7/2018 | Walters | E21B 43/267 |

OTHER PUBLICATIONS

Massaras, et al., Highly Accurate Prediction of Screenouts in the Eagle Ford Shale with the Screenout Index, SPE Annual Technical Conference and Exhibition, San Antonio, TX 2012, SPE 157613.

Kraemer, et al., A Novel Completion Method for Sequenced Fracturing in the Eagle Ford Shale, SPE Unconventional Resources Conference, The Woodlands, TX, 2014, SPE-169010-MS.

Lizak, et al., New Analysis of Step-Rate Injection Tests for Improved Fracture Stimulation Design, SPE International Symposium and Exhibition on Formation Damage Control, Lafayette, LA, 2006, SPE-98098.

International Search Report and Written Opinion received in corresponding International Application No. PCT/US2015/060005 dated Mar. 10, 2016.

* cited by examiner

REAL-TIME, CONTINUOUS-FLOW PRESSURE DIAGNOSTICS FOR ANALYZING AND DESIGNING DIVERSION CYCLES OF FRACTURING OPERATIONS

BACKGROUND

The present application relates to fracturing operations that include fluid diversion cycles.

Hydrocarbon-producing wells are often stimulated by hydraulic fracturing operations. Generally, a fracturing fluid may be introduced into a wellbore penetrating a subterranean formation at a hydraulic pressure sufficient to create or extend at least one fracture in the subterranean formation. Often, proppant particles, such as graded sand, are suspended in a portion of the fracturing fluid so that the proppant particles may be placed in the resultant fractures to maintain the integrity of the fractures (after the hydraulic pressure is released) as conductive channels within the formation through which hydrocarbons can flow during production operations.

When placing the proppant particles, the fracturing fluid containing the proppant particles takes the path of least resistance and can fill the fractures unevenly. In some instances, some or all of the fracture volume does not receive sufficient proppant to maintain the integrity of the fracture. Such fractures may close completely or substantially, thereby reducing the number of conductive channels and, consequently, the hydrocarbon flow during production operations.

In an attempt to address these problems, fracturing operations often are designed to include diversion cycles where diverting agents are pumped into the fractures having proppant therein (again, due to flow through paths of least resistance). The diverting agents at least partially reduce the permeability of the fracture having proppant therein, which increases the resistance to flow therethrough. Then, as new fractures are formed, subsequently placed proppant particles may be diverted to the new fractures because the flow therethrough is less resistant to fluid flow than the propped fractures with diverting agent therein.

Typically, the amount of diverting agent placed downhole during each of the diversion cycles is based on the past experience of operators. In some instances, pressure diagnostics may be performed at the beginning of or during the fracturing operation to ascertain the amount of fractures that need to be propped and diverted. In these pressure diagnostics, the wellbore pressure is measured at a series of reduced injection rates of the fracturing fluid and a zero injection rate of the fracturing fluid. Then, the change in wellbore pressure over all of the reduced and zero injection rates is used to estimate the extent of the fractures using known algorithms, which in turn, provides an estimation of the number of propping and diversion parameters for the fracturing operation (e.g., the number of corresponding cycles and amount of proppant particles and diverting agent to use).

Reducing the injection rate to zero in these methods is often undesirable because stopping fluid flow may cause already formed proppant packs to change. Additionally, using a zero injection rate adds time and cost to the fracturing operation. In some instances, over the course of a series of treatment for a single well, a half-day or more may be added to the fracturing operation when performing these pressure diagnostics.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present application relates to fracturing operations that include fluid diversion cycles and, more specifically, real-time, continuous-flow pressure diagnostics to analyze and design the fluid diversion cycles of fracturing operations.

The methods described herein are based on the dependence the wellbore pressure as a function of injection rate has on both near-wellbore friction and perforation friction. This dependence has been generally described as $P=aQ^c+bQ^2$, where P is the wellbore pressure, Q is the injection rate (or flow velocity), a is a coefficient related to near-wellbore friction, b is a coefficient related to perforation (or orifice) friction, and c is 0.4-0.7.

Figure 1:
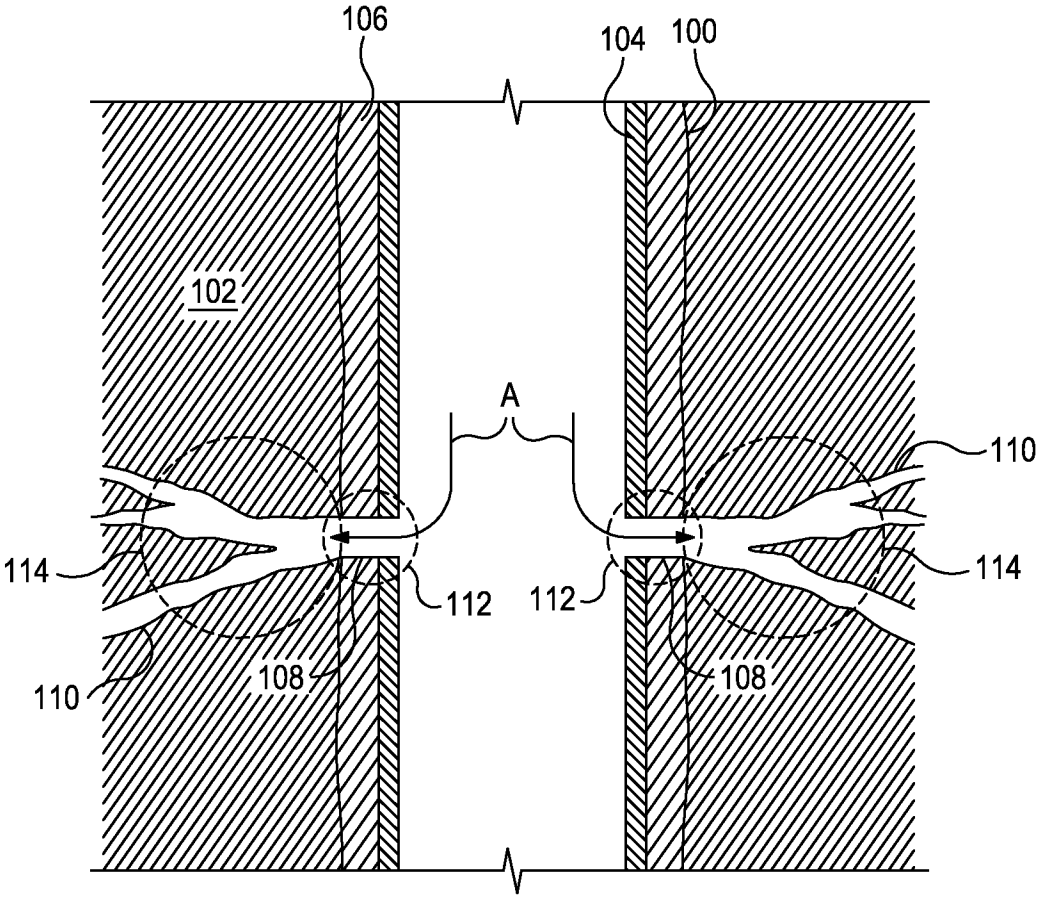
FIG. 1 illustrates a portion of a wellbore penetrating a subterranean formation where the wellbore is lined with a casing cemented in place with a cement sheath.

FIG. 1 illustrates a portion of a wellbore 100 penetrating a subterranean formation 102 where the wellbore 100 is lined with a casing 104 cemented in place with a cement sheath 106. A portion of the fracturing fluid flows along lines A into fractures 110 in the formation 102 via the perforations 108. The perforation friction described above relates to the friction (or force resisting) between the fluid and the perforations 108, which occurs in zones 112. The near-wellbore friction described above relates to the friction between the fluid and the fractures 110 or material therein that are close to the wellbore (e.g., within about 10 feet of the wellbore), which is highlighted as zones 114.

Based on the equation above for wellbore pressure as a function of injection rate, the changes in wellbore pressure are more dependent on near-wellbore friction at low injection rates and more dependent on perforation friction at high injection rates. The methods described herein use this relationship by monitoring wellbore pressure changes at low and/or high injection rates periodically throughout a fracturing operation to ascertain the conditions downhole.

For example, a large wellbore pressure change indicates a blocked path, which at low injection rates is the near-wellbore zones 114 and at high injection rates is the perforation zones 112. Conversely, a small wellbore pressure change indicated a substantially open path. By monitoring the wellbore pressure changes as a function of injection rate several times over the fracturing operations, the efficacy of a diversion cycle may be determined, which may guide the concentration of diverting agent used in subsequent diversion cycles.

As used herein, the term "design fracturing injection rate" refers to the rate of injection of the fracturing fluid at the beginning of a fracturing operation, which is sufficient to create or extend at least one fracture in the formation. In many instances, the design fracturing injection rate may be several times greater than a minimum injection rate necessary to create or extend at least one fracture in the formation. As used herein, the term "low injection rate" refers to an injection rate that is 1% to 50% of the design fracturing injection rate. In some instances, the low injection rate may preferably be 1% to 30% of the design fracturing injection rate. As fractures are created, propped, and diverted during the fracturing operation, greater injection rates may be needed to create new fractures the formation having undergone the various stages of the fracturing operations. Accordingly, the design fracturing injection rate is used herein as a reference value for determining low and high injection rates. As used herein, the term "high injection rate" refers to an injection rate that is 50% to 100% of the design fracturing injection rate.

Monitoring wellbore pressure changes at low and/or high injection rates periodically throughout a fracturing operation may be done with injection rate (IR) step cycles. As used herein the term "IR step cycle" refers to step changes in the rate of fracturing fluid injection to two or more injection rates in series where each injection rate in the series is maintained for a period of time (e.g., about 1 second to about 5 minutes). Each of the maintained injection rate may be referred to herein as an "injection rate step."

The wellbore pressure reacts to changes in the rate of injection. Therefore, wellbore pressure changes resulting from an IR ("Injection Rate") step cycle performed with two or more low injection rate steps may be useful in analyzing near-wellbore friction. Similarly, wellbore pressure changes resulting from an IR step cycle performed with two or more high injection rate steps may be useful in analyzing perforation friction. Hybrids of the foregoing may also be performed.

Figure 2:
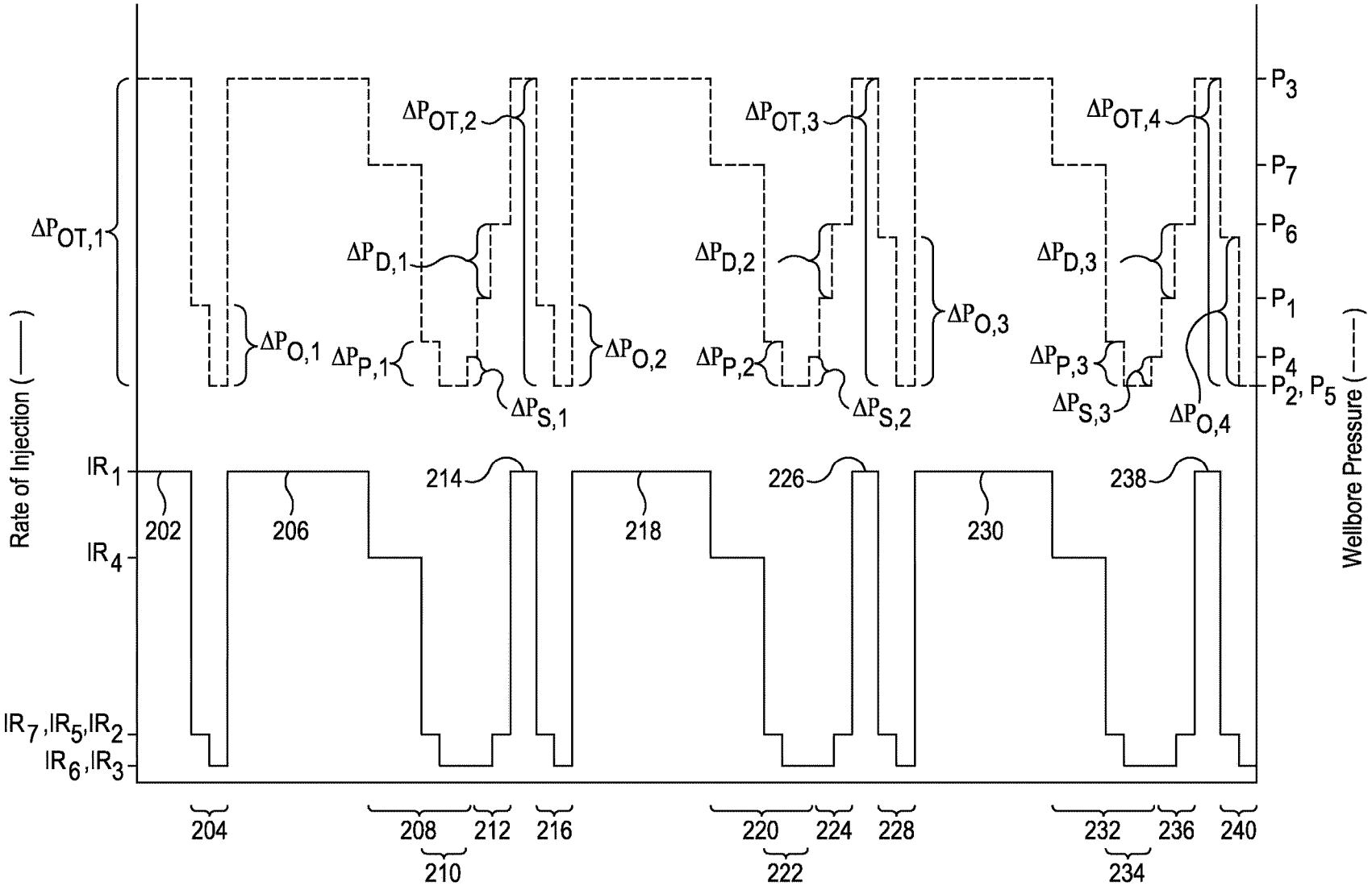
FIG. 2 provides theoretical plots of the rate of injection of a fracturing fluid and the wellbore pressure as a function of time for a fracturing operation.

FIG. 2 provides theoretical plots of the rate of injection of a fracturing fluid and the wellbore pressure as a function of time for a fracturing operation according to at least some embodiments described herein. As used herein, the term "wellbore pressure" refers to the fluid pressure in the wellbore, which may be measured at a plurality of locations (e.g., at the wellhead, in the wellbore, or at bottomhole). The selection of the measurement location is not critical so long as it is consistent throughout the various measurements.

For the sake of simplicity, the rate of injection and wellbore pressure are illustrated as instantaneous, and the injection rates and wellbore pressures are illustrated as maintaining constant values in FIG. 2 and subsequent illustrations of the methods of the present disclosure. One skilled in the art would recognize that implementation of the methods described herein in the field would involve ramping up or down to the various injection rates and that the wellbore pressure may fluctuate while maintaining injection rates. Further, relative to maintaining injection rates, the term "maintaining" or derivatives thereof refer to holding the injection rate substantially constant (i.e., the injection rate±20%). Additionally, when illustrating the various IR step cycles in FIG. 2 and subsequent illustrations of the methods of the present disclosure, many of the injection rates appear to be equal. However, in practice, the injection rate may be substantially equal ("≈"), which, as used herein, refers to the corresponding values being within 40% of each other.

As illustrated in FIG. 2, a fracturing cycle 202 is first performed at a design fracturing injection rate $IR_1$ to create or extend at least one fracture in the subterranean formation. Then, an open low IR step cycle 204 is performed by reducing the rate of injection from $IR_1$ to $IR_2$ and then from $IR_2$ to $IR_3$, wherein $IR_2$ and $IR_3$ are low injection rates. As used herein, the term "open low IR step cycle" refers to an IR step cycle at low IR injection rates that are performed after a fracturing cycle and before a subsequent diversion cycle so that the fractures are most permeable in light of any previously performed cycles.

Figures 3A, 3B, 3C:
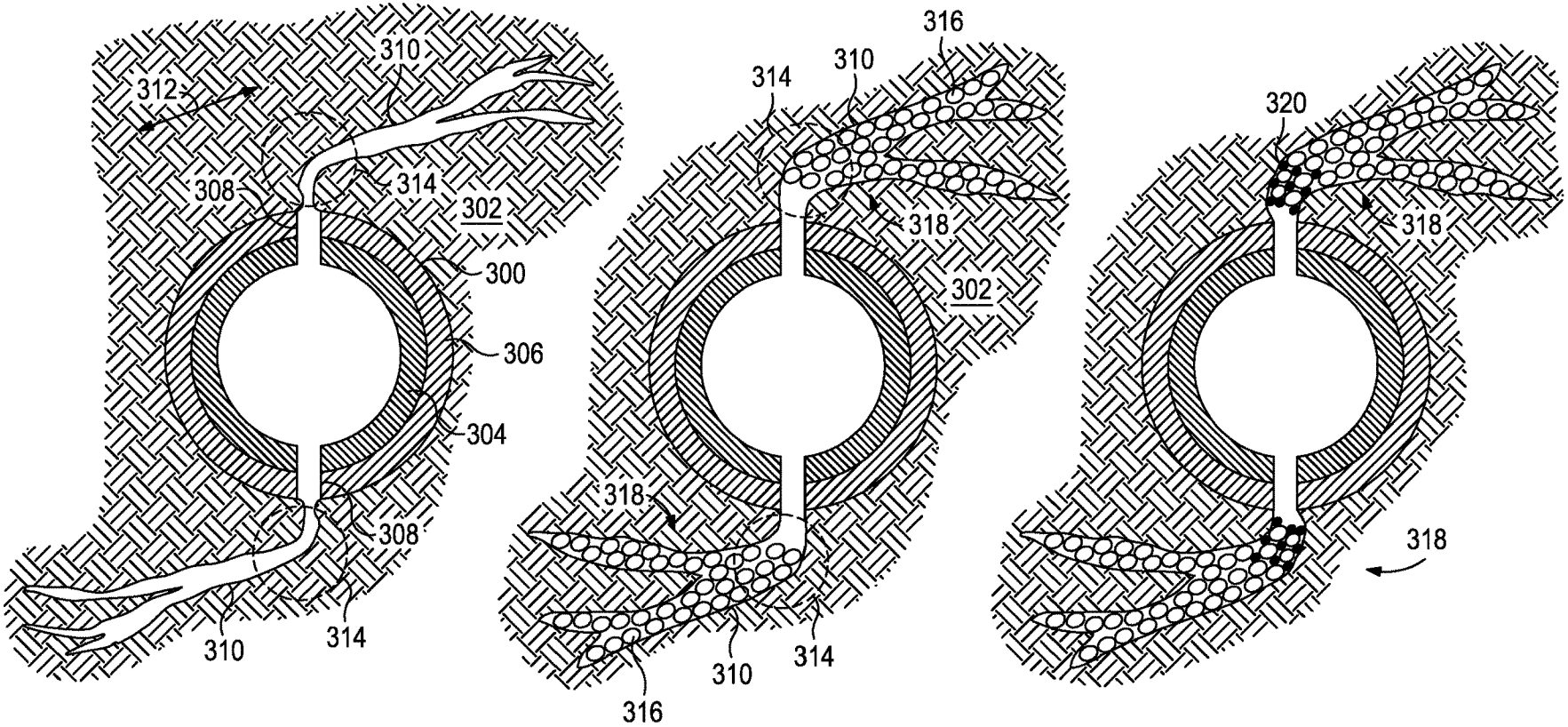
FIGS. 3A-3C provide cross-sectional views of a wellbore penetrating a subterranean formation to illustrate the formation changes during the various cycles of the fracturing operation of FIG. 2.

FIGS. 3A-3C provide cross-sectional views of a wellbore 300 penetrating a subterranean formation 302 to illustrate the formation changes during the various cycles of the fracturing operation of FIG. 2. FIG. 3A illustrates a fractured formation after the fracturing cycle 202. The wellbore 300 is lined with a casing 304 cemented in place with a cement sheath 306. During fracturing, the wellbore pressure creates fractures 310 that extend from the perforations 308 in the wellbore 300, cement sheath 306, and casing 304. In many instances, the fractures preferably form along a fracturing plane 312 of the formation 302. In the illustrated wellbore cross-section, the fracture plane 312 is not parallel to the perforations 308. Therefore, the fracture 310 turns from the direction of the perforations 308 to the fracturing plane 312 of the formation 302 within the near-wellbore region. The open low IR step cycle 204 provides a measure of the tortuosity in the near-wellbore region 314 of the fractures 310. The greater the pressure change between the steps of the open low IR step cycle 204, the greater the tortuosity.

With continued reference to FIGS. 2 and 3A-3C, after the open low IR step cycle 204, the rate of injection is illustrated as increasing back to $IR_1$ for a propping cycle 206 where at least a portion of the fracturing fluid introduced during the propping cycle 206 includes proppant particles 316. The proppant particles 316 form a proppant pack 318 in the fractures 310 formed during the fracturing cycle 202 and maintained during the propping cycle 206. In some instances, the propping cycle 206 may create additional fractures or extend existing fractures 310 that may then have proppant packs 318 formed therein.

As illustrated in FIG. 3B, during the propping cycle 206, the proppant particles 316 erode the formation 302 in the near-wellbore region 314 as the proppant particles 316 impact the formation 302 during the turn and throughout the length of the fractures 310. As illustrated, the portion of the fracture 310 in the near-wellbore region 314 expand, which reduces tortuosity in the near-wellbore region 314. Accordingly, the pressure change in between the steps of an upcoming propped low IR cycle 210 may be less than the pressure change associated with the open low IR step cycle 204.

After the propping cycle 206, a diversion cycle 208 may be performed. As illustrated, the diversion cycle 208 is initially performed at a reduced injection rate $IR_4$ and a diverting agent 320 is added to the fracturing fluid, which may optionally include low concentrations of proppant particles 316. The reduction in rate of injection allows for concentrating the diverting agent 320 in the fracturing fluid. In some instances, when the diverting agent 320 can be added to the fracturing fluid at the sufficient concentration for the diversion cycle 208, the fracturing fluid with diverting agent 320 therein may be flowed at the injection rate of the propping cycle 206. Generally, after introduction of the diverting agent 320 while at $IR_4$ or another injection rate used when introducing the diverting agent, the fracturing fluid is pumped without diverting agent 320 or proppant particles 316, which allows for the diverting agent 320 to be conveyed by fluid flow to the downhole locations where the previously placed proppant packs 318 are located without using excess diverting agent 320.

After the introduction of the diverting agent 320, the fracturing fluid may be flowed at $IR_4$ until the diverting agent 320 approaches the fractures 310, which can be determined using the injection rate, the wellbore configuration, and depth of the fractures from the well head. As the diverting agent 320 approaches the fractures 310, the rate of injection may be adjusted to perform a propped low IR step cycle 210 as part of the diversion cycle 208. During the propped low IR step cycle 210, the rate of injection is reduced to $IR_4$ and then $IR_5$ as illustrated, which may be injection rates substantially equal to $IR_2$ and $IR_3$, respectively. The rate of injection is maintained at $IR_5$ until a pressure increase ($\Delta P_S$) is observed and stabilizes. This pressure increase indicates that the diverting agent 320 has been seated in the interstitial spaces of the proppant packs 318 formed during the propping cycle 206, as illustrated in FIG. 3C. Then, a diverted IR step cycle 212 may be performed where the first step is at $IR_3$ (or the injection rate of the last step of the propped low IR step cycle 210) and the second step is at $IR_4$. As used herein, the term "diverted IR step cycle" refers to an IR step cycle performed after a diversion cycle and before a subsequent fracturing cycle so that the current fractures are at their lowest permeability in light of any previously performed cycles. Accordingly, the pressure change in between the steps of the diverted IR step cycle 212 may be indicated by the efficacy of the diversion cycle 208. For example, as compared to the pressure change associated with the propped low IR step cycle 210, a higher pressure change for the diverted IR step cycle 212 may indicate effective diversion, while a substantially equal pressure change may indicate ineffective diversion and another diversion cycle 208 may be performed immediately thereafter with a higher concentration of diverting agent.

After the diverted IR step cycle 212, a fracturing cycle 214 may be performed to potentially create new fractures in the formation. For the fracturing cycle 214, the rate of injection may be increased back to $IR_1$, an injection rate substantially equal to $IR_1$, or another injection rate sufficient to create or extend least one fracture in the formation in light of the previously performed cycles. Then, an open low IR step cycle 216 similar to, and illustrated exactly like, the open low IR step cycle 204 may be performed. This series of cycles may be continued multiple times. Specifically illustrated after the open low IR step cycle 216 are, in order, a propping cycle 218, a diversion cycle 220 that includes propped low IR step cycle 222, a diverted IR step cycle 224, a fracturing cycle 226, an open low IR step cycle 228, a propping step cycle 230, a diversion cycle 232 that includes propped low IR step cycle 234, a diverted IR step cycle 236, a fracturing cycle 238, and an IR step cycle 240.

Turning now to the wellbore pressure as a function of time illustrated in FIG. 2, the plot provides a theoretical illustration of how the wellbore pressure may change in response to the changes in rate of injection and the fracturing, propping, and diverting performed downhole. The wellbore pressure (precise or average wellbore pressure) for each of the cycles and injection rate steps therein may be recorded and analyzed. In FIG. 2, the various IR step cycles 204, 210, 212, 216, 222, 224, 228, 234, 236, and 240 are performed using low injection rate steps, which are related to the near-wellbore friction. Accordingly, the analysis of the wellbore pressures may provide an indication of the efficacy of the diverting cycles and of the concentration of diverting agent to use in subsequent diverting cycles.

When analyzing the pressures, several pressure changes ($\Delta P$) may be calculated and compared. When using two pressures to calculate a pressure change, $\Delta P=|P_x-P_y|$.

As used herein, the term $\Delta P_O$ or "open pressure change" refers to the pressure change between the injection steps of an open low IR step cycle. For example, $\Delta P_{O,1}$ corresponding to the open low IR step cycle 204 illustrated in FIG. 2 is the absolute value of the difference between the wellbore pressure $P_1$ corresponding to the first IR step at $IR_2$ and the wellbore pressure $P_2$ corresponding to the second IR step at $IR_3$ (i.e., $\Delta P_{O,1}=|P_1-P_2|$).

As used herein, the term $\Delta P_{OT}$ or "total open pressure change" refers to the pressure change between the injection step of an open low IR step cycle having the lowest wellbore pressure and the previous fracturing cycle. For example, as illustrated in FIG. 2, $P_2$ is the lower wellbore pressure of $P_1$ and $P_2$ for the open low IR step cycle 204, and $P_3$ is the wellbore pressure of the fracturing cycle 202 that occurred preceding the open low IR step cycle 204. Therefore, $\Delta P_{OT,1}$ corresponding to the open low IR step cycle 204 is $|P_2-P_3|$.

As illustrated in FIG. 2, each open low IR step cycle has a corresponding $\Delta P_O$ and $\Delta P_{OT}$. Specifically, $\Delta P_{O,1}$ and $\Delta P_{OT,1}$ correspond to open low IR step cycle 204, $\Delta P_{O,2}$ and $\Delta P_{OT,2}$ correspond to open low IR step cycle 216, $\Delta P_{O,3}$ and $\Delta P_{OT,3}$ correspond to open low IR step cycle 228, and $\Delta P_{O,4}$ and $\Delta P_{OT,4}$ correspond to open low IR step cycle 240.

As used herein, the term $\Delta P_P$ or "propped pressure change" refers to the pressure change between the injection steps of a propped low IR step cycle. For example, $\Delta P_{P,1}$ corresponding to the propped low IR step cycle 210 illustrated in FIG. 2 is the absolute value of the difference between the wellbore pressure $P_4$ corresponding to the first IR step at $IR_5$ and the wellbore pressure $P_5$ corresponding to the second IR step at $IR_6$ (i.e., $\Delta P_{D,1}=|P_4-P_5|$).

As illustrated in FIG. 2, each propped IR step cycle has a corresponding $\Delta P_P$. Specifically, $\Delta P_{P,1}$ corresponds to propped IR step cycle 210, $\Delta P_{P,2}$ corresponds to propped low IR step cycle 222, and $\Delta P_{P,3}$ corresponds to propped low IR step cycle 234.

As described above, $\Delta P_S$ refers to the increase in pressure due to seating of the diverting agent.

As used herein, the term $\Delta P_D$ or "diverted pressure change" refers to the pressure change between the injection steps of a diverting IR step cycle. For example, $\Delta P_{D,1}$ corresponding to the diverted IR step cycle 212 illustrated in FIG. 2 is the absolute value of the difference between the wellbore pressure $P_7$ corresponding to the first IR step at $IR_6$ and the wellbore pressure $P_8$ corresponding to the second IR step at $IR_7$ (i.e., $\Delta P_{D,1}=|P_6-P_7|$).

As illustrated in FIG. 2, each diverted IR step cycle has a corresponding $\Delta P_D$. Specifically, $\Delta P_{D,1}$ corresponds to diverted IR step cycle 212, $\Delta P_{D,2}$ corresponds to diverted low IR step cycle 224, and $\Delta P_{D,3}$ corresponds to diverted low IR step cycle 236.

$\Delta P_O$ provides an indication of the near-wellbore friction and, consequently, fluid flow through the fractures, which may be newly formed by the corresponding fracturing cycle, previously formed, include proppant, or be partially diverted. A comparison of the $\Delta P_O$ corresponding to two or more open low IR step cycles may be used to design upcoming diverting cycles and, more specifically, the concentration of diverting agent to use. For example, if $\Delta P_{O,1}$ is within about 25% of the $\Delta P_{O,2}$ for a subsequent open low IR step cycle (i.e., $1.25\Delta P_{O,1}>\Delta P_{O,2}$) this may indicate that the amount of fracture that needs to be diverted is substantially unchanged, which may be due to newly formed fracture or ineffective diverting. Accordingly, the amount of diverting agent in a subsequent diversion cycle may be the same or greater than the amount previously used. However, the analysis of $\Delta P_O$ should be viewed in light of a $\Delta P_{OT}$, because $\Delta P_O/\Delta P_{OT}$ increases as more fractures are propped and effectively diverted. Accordingly, as the fracturing operation nears completion the $\Delta P_O$ may change to a lesser degree. Table 1 provides a matrix for analyzing the $\Delta P_{O,1}$ relationship to $\Delta P_{OT,2}$, and the $\Delta P_{O,2}$ relationship to $\Delta P_{OT,2}$ to arrive at an action including changing the diverting agent concentration in the second cycle $[DA_2]$ relative to the previously used diverting agent concentration $[DA_2]$.

TABLE 1

| $\Delta P_{O,1}$ relationship to $\Delta P_{O,2}$ | $\Delta P_{O,2}$ relationship to $\Delta P_{OT,2}$ | Action |
|---|---|---|
| $\Delta P_{O,1} > 0.8\Delta P_{O,2}$ | $\Delta P_{O,2} < 0.5\Delta P_{OT,2}$ | $[DA_1] \leq [DA_2]$ |
| $\Delta P_{O,1} > 0.8\Delta P_{O,2}$ | $0.5\Delta P_{OT,2} \leq \Delta P_{O,2} < 0.75\Delta P_{OT,2}$ | $[DA_1] \geq [DA_2]$ |
| $\Delta P_{O,1} > 0.8\Delta P_{O,2}$ | $0.75\Delta P_{OT,2} \leq \Delta P_{O,2} < 0.9\Delta P_{OT,2}$ | $0.5[DA_1] \geq [DA_2]$ |
| $0.5\Delta P_{O,2} < \Delta P_{O,1} \leq 0.8\Delta P_{O,2}$ | $\Delta P_{O,2} < 0.5\Delta P_{OT,2}$ | $[DA_1] \geq [DA_2]$ |
| $0.5\Delta P_{O,2} < \Delta P_{O,1} \leq 0.8\Delta P_{O,2}$ | $0.5\Delta P_{OT,2} \leq \Delta P_{O,2} < 0.75\Delta P_{OT,2}$ | $0.5[DA_1] \geq [DA_2]$ |
| $0.5\Delta P_{O,2} < \Delta P_{O,1} \leq 0.8\Delta P_{O,2}$ | $0.75\Delta P_{OT,2} \leq \Delta P_{O,2} < 0.9\Delta P_{OT,2}$ | $0.25[DA_1] \geq [DA_2]$ |
| $\Delta P_{O,1} \leq 0.5\Delta P_{O,2}$ | $\Delta P_{O,2} < 0.5\Delta P_{OT,2}$ | $0.5[DA_1] \geq [DA_2]$ |
| $\Delta P_{O,1} \leq 0.5\Delta P_{O,2}$ | $0.5\Delta P_{OT,2} \leq \Delta P_{O,2} < 0.75\Delta P_{OT,2}$ | $0.25[DA_1] \geq [DA_2]$ |
| $\Delta P_{O,1} \leq 0.5\Delta P_{O,2}$ | $0.75\Delta P_{OT,2} \leq \Delta P_{O,2} < 0.9\Delta P_{OT,2}$ | $0.1[DA_1] \geq [DA_2]$ |
| | $\Delta P_{O,2} > 0.9\Delta P_{OT,2}$ | stop fracturing operation |

The exemplary matrix provided in Table 1 may be altered depending on the subterranean formation, wellbore pressure limits for a given fracturing operation, the composition of the diverting agent, and the like.

$\Delta P_D$ as compared to the foregoing $\Delta P_P$ provides an indication of the near-wellbore friction and, consequently, reduced fluid flow through the propped fractures as a result of the diverting agent being incorporated in the propped fractures. Therefore, the $\Delta P_P/\Delta P_D$, which theoretically may range from 0 to 1, provides an indication of the extent to which the propped fracture were plugged with diverter. When $\Delta P_P/\Delta P_D$ is greater than 0.5, the diverting cycle between the propping cycle and diverted IR step cycle may be considered effective. When $\Delta P_P/\Delta P_D$ is less than 0.25, the diverting cycle between the propping cycle and diverted IR step cycle may be considered ineffective and a diverting cycle may be repeated with a higher concentration or amount of diverting agent in the repeated diverting cycle.

In some instances, $\Delta P_D$ for various diverting cycles may be compared. For example, $\Delta P_{D,1}\approx\Delta P_{D,2}\approx\Delta P_{D,3}$ or $\Delta P_{D,1}<\Delta P_{D,2}<\Delta P_{D,3}$ may indicate that each diversion cycle is effective. In another example, $\Delta P_{D,1}\approx\Delta P_{D,2}>\Delta P_{D,3}$ or $\Delta P_{D,1}<\Delta P_{D,2}>\Delta P_{D,3}$ may indicate that the third diversion cycle was not effective and should be repeated with a higher concentration or amount of diverting agent in the repeated diverting cycle.

In some instances, a correlation may be derived from the measured $\Delta P_S$ (which may be used to indicate the efficacy of the diversion cycle), the concentration of diverting agent implemented during the diversion cycle, and one or more of the immediately previous $\Delta P_P$, the immediately after $\Delta P_D$, or the immediately after $\Delta P_O$. The produced correlation may provide a table, a graph, an algorithm, or the like that relates the $\Delta P_P$, $\Delta P_D$, or $\Delta P_O$ to the concentration of diverting agent that provides for an effective diversion cycle. For example, after a plurality of series of cycles have been performed, the $\Delta P_S$ for each series of cycles may be compared where a low $\Delta P_S$ may indicate that little to no diversion has occurred and a high $\Delta P_S$ or pressure out may indicate that the fractures have been screened out because of too much diverting agent. If $\Delta P_S$ is low (i.e., an ineffective diversion cycle), the corresponding $\Delta P_P$, $\Delta P_D$, or $\Delta P_O$ measured may be correlated to a higher concentration of diverting agent than added during the diversion cycle when the $\Delta P_S$ was measured. The example provided herein illustrates this method with $\Delta P_P$, but could be expanded to $\Delta P_D$, $\Delta P_O$ or a combination of two or more of $\Delta P_P$, $\Delta P_D$, or $\Delta P_O$.

In some embodiments, the various $\Delta P$ may be plotted as a function of time so that trends of increasing or decreasing $\Delta P$ may be observed and analyzed to determine if a remedial action is needed.

As described above, the IR step cycles of the methods discloses herein include low injection rate cycles, high injection rate cycles, or hybrids thereof. FIG. 2 illustrates only low injection rate cycles.

When high IR step cycles are performed, the various corresponding $\Delta P$ values provide an indication of the perforation friction and the degree to which fluid is capable of flowing therethrough. High injection rate cycles may be performed periodically throughout the fracturing operation to provide an indication of the number of perforation through which fluid readily flows. For example, after a fracturing cycle, a high IR step cycle may be performed to ascertain the open perforation. Then, if performed after the diverting cycle and before the next fracturing cycle, the number of perforations plugged by diverting agent may be ascertained. When referring herein to a "number" of perforations open, the number is a qualitative number where the comparison of two or more $\Delta P$ for high IR step cycles indicates that more or less perforations are open.

In some instances, IR step cycles may include a high IR step and a low IR step.

Figure 4:
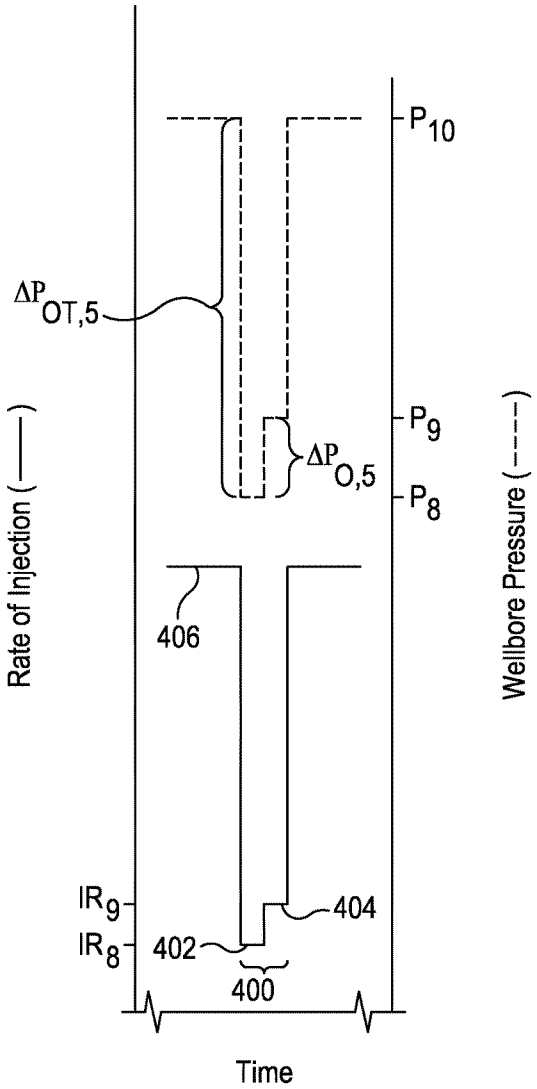
FIG. 4 illustrates an open low IR step cycle with two low injection rate steps.

As described above, the IR step cycles of the methods discloses herein include two or more injection rate steps. Illustrated in FIG. 2, each IR step cycle has two low injection rate steps. FIG. 4 illustrates an open low IR step cycle 400 with two low injection rate steps where the injection rate $IR_8$ of the first injection rate step 402 is less than the injection rate $IR_9$ of the second injection rate step 404 (i.e., $IR_8<IR_9$). In this example, a $\Delta P_O$ corresponding to the open low IR step cycle 200 is calculated as is described in FIG. 2, specifically, $\Delta P_{O,5}=|P_8-P_9|$, where $P_8$ and $P_{10}$ are the wellbore pressures at $IR_8$ and $IR_9$, respectively. Additionally, $\Delta P_{OT,5}=|P_8-P_{10}|$, where $P_{10}$ is the wellbore pressure at the prior fracturing cycle 406. Similar steps may be used when performing low propped IR step cycles, low diverted IR step cycles, and high IR step cycles (where the injection rates are increased accordingly).

Figure 5:
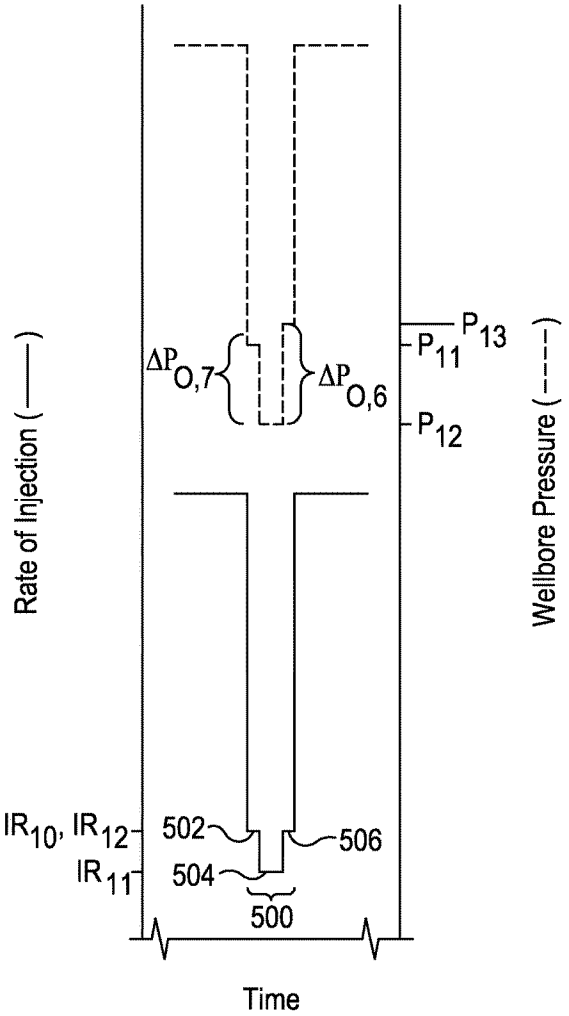
FIG. 5 illustrates an open low IR step cycle with three injection rate steps.

FIG. 5 illustrates an open low IR step cycle 500 with three injection rate steps, with a first injection step 502 at an injection rate $IR_{10}$, a second injection step 504 at an injection rate $IR_{11}$, and a third injection step 506 at an injection rate $IR_{12}$ where $IR_{11}<(IR_{10}\approx IR_{12})$. In this example, a $\Delta P_O$ may be calculated multiple ways. For example, in some instances, a $\Delta P_O$ corresponding to the open low IR step cycle 500 may be calculated where the wellbore pressures at the first and third injection steps 502,506 are averaged (i.e., $\Delta P_{O,6}=|P_{11}-((P_{10}+P_{12})/2)|$), where $P_{10}$, $P_{11}$, and $P_{12}$ are the wellbore pressure at the first, second, and third injection steps 502,504,506, respectively. In alternate embodiments, a $\Delta P_O$ corresponding to the open low IR step cycle 500 may be calculated using the wellbore pressures at the second and third injection rates only (i.e., $\Delta P_{O,7}=|P_1-P_{12}|$). Similar steps may be used when performing low propped IR step cycles, low diverted IR step cycles, and high IR step cycles (where the injection rates are increased accordingly).

Figure 6:
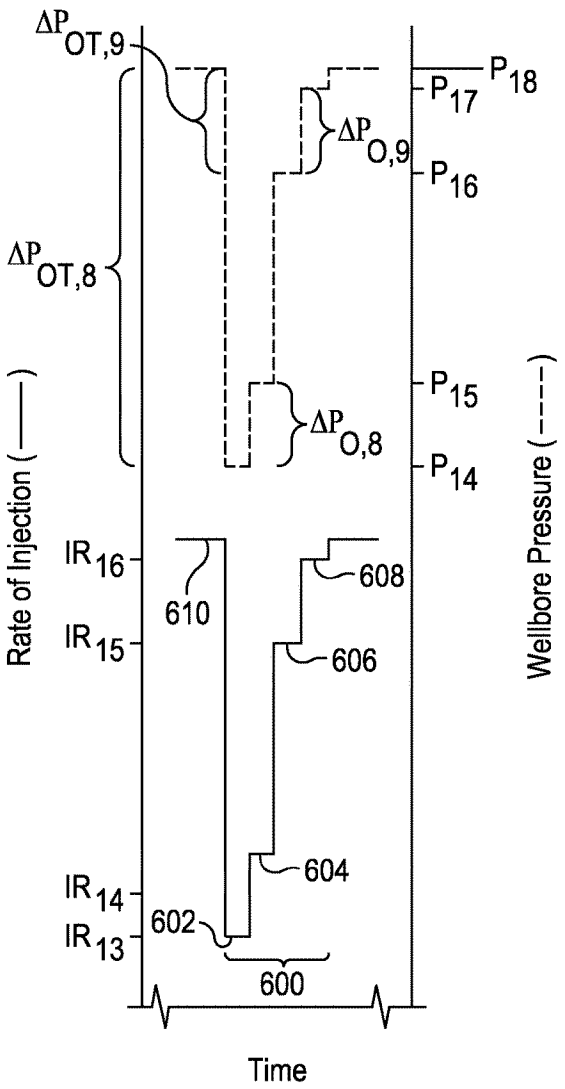
FIG. 6 illustrates an open low IR step cycle with four injection rate steps where the first two are low injection rate steps and the last two are high injection rate steps.

In some instances, an IR step cycle may be a hybrid that includes both low injection rate steps and high injection rate steps. For example, FIG. 6 illustrates an open low IR step cycle 600 with four injection rate steps, where the first two are low injection rate steps and the last two are high injection rate steps. More specifically, the open low IR step cycle 600 includes a first low injection rate step 602 at an injection rate of $IR_{13}$ and has a corresponding wellbore pressure $P_{14}$, followed by a second low injection rate step 604 at an injection rate of $IR_{14}$ and has a corresponding wellbore pressure $P_{15}$ where $IR_{14}>IR_{13}$, followed by a first high injection rate step 606 at an injection rate of $IR_{15}$ and has a corresponding wellbore pressure $P_{16}$, followed by a second high injection rate step 608 at an injection rate of $IR_{16}$ and has a corresponding wellbore pressure $P_{17}$ where $IR_{16}>IR_{15}$. Further, before the open low IR step cycle 600 is a fracturing cycle 610 having a corresponding wellbore pressure $P_{18}$. Accordingly, the various $\Delta P$ may be calculated as: $\Delta P_{O,8}$ (corresponding the low injection rate steps)$=|P_{14}-P_{15}|$, $\Delta P_{OT,8}$ (corresponding the low injection rate steps)$=|P_{14}-P_{18}|$, $\Delta P_{O,9}$ (corresponding the high injection rate steps) $=|P_{16}-P_{17}|$, and $\Delta P_{OT,9}$ (corresponding the high injection rate steps)$=|P_{16}-P_{18}|$. A similar diverted IR step cycle with two low and two high injection rate cycles could be employed after a diversion cycle. Additionally, the concept of hybrid IR step cycles with two low and two high injection rate cycles may be applied to propped and diverted IR step cycles. Further, in some instances, the high injection rate steps may be before the low injection rate steps.

The fracturing operations of the present disclosure may include at least one open low IR step cycle, at least one propped IR step cycle, at least one diverted IR step cycle, or a combination thereof. In some instances, a fracturing operation may include a fracturing step, a propping step, and a diverting step and another fracturing step in sequence without an open low IR step cycle or a diverted IR step cycle in the sequence.

In some embodiments, the fracturing operations described herein may be performed on multiple sections of a wellbore, where during the fracturing operation the section being fractured is zonally isolated from the remaining sections of the wellbore. In such instances, after a first section is fractured, the various $\Delta P$ from the first section fracturing operation may be used for comparison to the various $\Delta P$ from any subsequent section fracturing operation.

In some embodiments, the fracturing operations described herein may be performed in a first wellbore penetrating a subterranean formation and used to guide subsequent fracturing operations in a second wellbore penetrating the same subterranean formation or a different subterranean formation with similar properties like Young's modulus, closure pressure, lithology, etc. In some instances, the various $\Delta P$ from fracturing operations in the second wellbore may be compared to the various $\Delta P$ from the first wellbore fracturing operation.

In various embodiments, systems configured for fracturing subterranean formations according to the methods of the present disclosure are described. In various embodiments, the systems can comprise a pump fluidly coupled to a tubular, the tubular containing a fracturing fluid.

The pump may be a high pressure pump in some embodiments. As used herein, the term "high pressure pump" will refer to a pump that is capable of delivering a fluid downhole at a pressure of about 1000 psi or greater. A high pressure pump may be used when it is desired to introduce the fracturing fluid to a subterranean formation at or above a fracture gradient of the subterranean formation, but it may also be used in cases where fracturing is not desired. In some embodiments, the high pressure pump may be capable of fluidly conveying particulate matter, such as proppant particulates, into the subterranean formation. Suitable high pressure pumps will be known to one having ordinary skill in the art and may include, but are not limited to, floating piston pumps and positive displacement pumps.

In other embodiments, the pump may be a low pressure pump. As used herein, the term "low pressure pump" will refer to a pump that operates at a pressure of about 1000 psi or less. In some embodiments, a low pressure pump may be fluidly coupled to a high pressure pump that is fluidly coupled to the tubular. That is, in such embodiments, the low pressure pump may be configured to convey the fracturing fluid to the high pressure pump. In such embodiments, the low pressure pump may "step up" the pressure of the fracturing fluid before it reaches the high pressure pump.

In some embodiments, the systems described herein can further comprise a mixing tank that is upstream of the pump and in which the fracturing fluid is formulated (e.g., for the addition of diverting agent and proppant particles as needed). In various embodiments, the pump (e.g., a low pressure pump, a high pressure pump, or a combination thereof) may convey the fracturing fluid from the mixing tank or other source of the fracturing fluid to the tubular. In other embodiments, however, the fracturing fluid can be formulated offsite and transported to a worksite, in which case the fracturing fluid may be introduced to the tubular via the pump directly from its shipping container (e.g., a truck, a railcar, a barge, or the like) or from a transport pipeline. In either case, the fracturing fluid may be drawn into the pump, elevated to an appropriate pressure, and then introduced into the tubular for delivery downhole.

Figure 7:
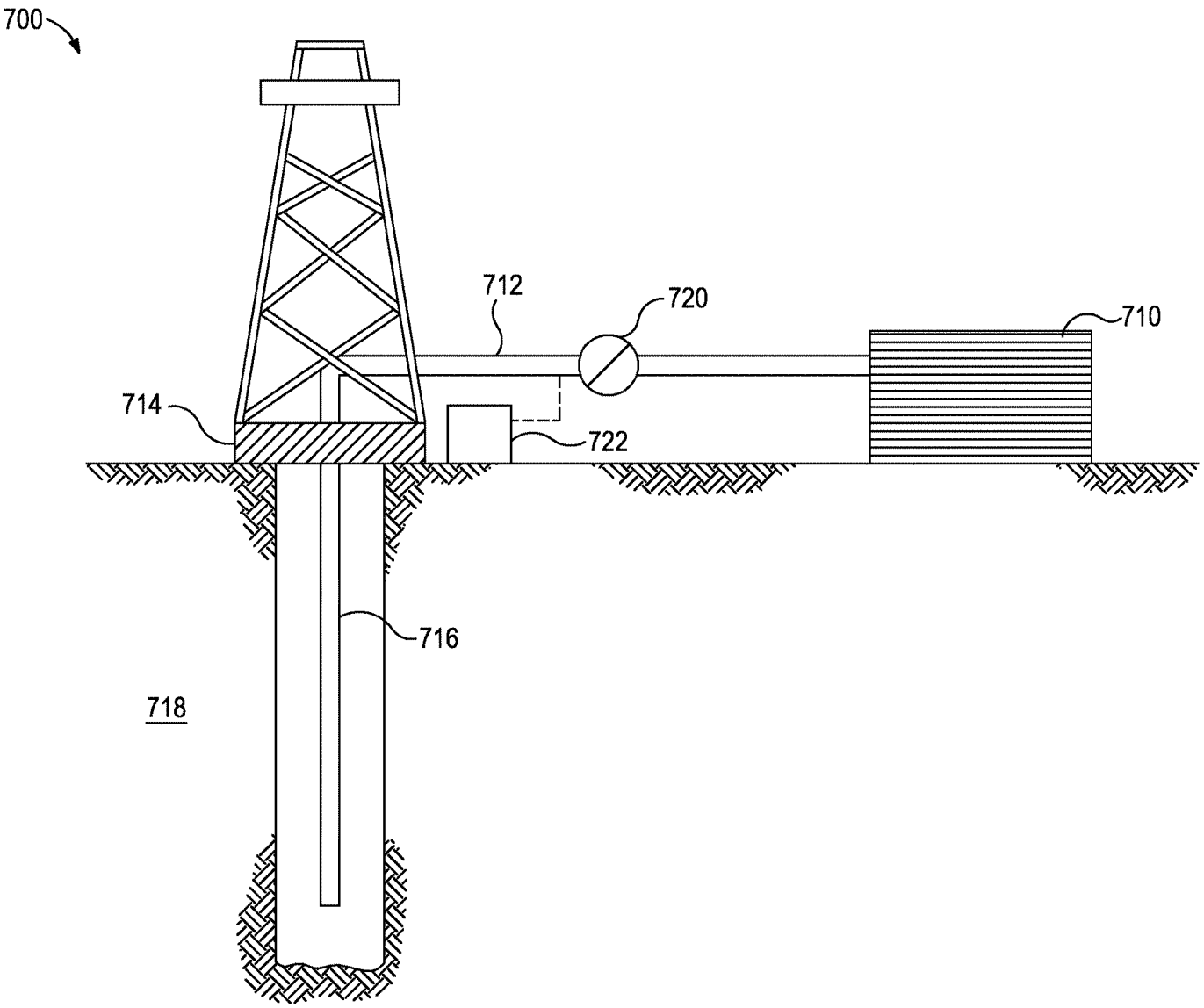
FIG. 7 provides an illustrative schematic for fracturing a subterranean formation according to one or more of the methods described herein.

FIG. 7 shows an illustrative schematic of a system that may deliver fracturing fluids to a downhole location, according to one or more embodiments. It should be noted that while FIG. 7 generally depicts a land-based system, it is to be recognized that like systems may be operated in subsea locations as well. As depicted in FIG. 7, system 700 may include mixing tank 710, in which a fracturing fluid of the present invention may be formulated. The fracturing fluid may be conveyed via line 712 to wellhead 714, where the fracturing fluid enters tubular 716, tubular 716 extending from wellhead 714 into subterranean formation 718. Upon being ejected from tubular 716, the fracturing fluid may subsequently penetrate into subterranean formation 718. In some instances, tubular 716 may have a plurality of orifices (not shown) through which the fracturing fluid may enter the wellbore proximal to a portion of the subterranean formation 718 to be fractured. In some instances, the wellbore may further comprise equipment or tools (not shown) for zonal isolation of a portion of the subterranean formation 718 to be fractured.

Pump 720 may be configured to raise the pressure of the fracturing fluid to a desired degree before its introduction into tubular 716. It is to be recognized that system 700 is merely exemplary in nature and various additional components may be present that have not necessarily been depicted in FIG. 7 in the interest of clarity. Non-limiting additional components that may be present include, but are not limited to, supply hoppers, valves, condensers, adapters, joints, gauges, sensors, compressors, pressure controllers, pressure sensors, flow rate controllers, flow rate sensors, temperature sensors, and the like.

Although not depicted in FIG. 7, the fracturing fluid may, in some embodiments, flow back to wellhead 714 and exit subterranean formation 718. In some embodiments, the fracturing fluid that has flowed back to wellhead 714 may subsequently be recovered and recirculated to subterranean formation 718.

It is also to be recognized that the disclosed fracturing fluids may also directly or indirectly affect the various downhole equipment and tools that may come into contact with the fracturing fluids during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, other wellbore isolation devices or components, and the like. Any of these components may be included in the systems generally described above and depicted in FIG. 7.

In some instances, the system 700 may include a control system 722 communicably coupled to a portion of the system 700 for recording measured wellbore pressures, recording rates of injection and in some instances, controlling rates of injection. The control system 722 may be useful in performing the analyses of the various ΔP described herein. The control system 722 may automatically control the rates of injection and concentrations of diverting agent and/or proppant particles in the fracturing fluids to execute the methods and analyses described herein. In some instances, the control system 722 may have or be coupled to a display for showing the wellbore pressure and/or injection flow rate as a function of time, the various ΔP associated therewith, and the like. Then, an operator (on-site or off-site) may make changes to the fracturing operation in accordance with the methods and analyses described herein.

It is recognized that the various embodiments herein directed to computer control and algorithms, including various blocks, modules, elements, components, methods, and algorithms, can be implemented using computer hardware, software, combinations thereof, and the like. To illustrate this interchangeability of hardware and software, various illustrative blocks, modules, elements, components, methods and algorithms have been described generally in terms of their functionality. Whether such functionality is implemented as hardware or software will depend upon the particular application and any imposed design constraints. For at least this reason, it is to be recognized that one of ordinary skill in the art can implement the described functionality in a variety of ways for a particular application. Further, various components and blocks can be arranged in a different order or partitioned differently, for example, without departing from the scope of the embodiments expressly described.

Computer hardware used to implement the various illustrative blocks, modules, elements, components, methods, and algorithms described herein can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable programmable read only memory (EPROM)), registers, hard disks, removable disks, CD-ROMS, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM, and flash EPROM.

Embodiments described herein include, but are not limited to, Embodiments A-C. Embodiment A is a method that comprises: performing a fracturing cycle on a section of a wellbore, the fracturing cycle comprising introducing a fracturing fluid into a wellbore penetrating a subterranean formation at a design fracturing injection rate to create at least one first fracture in the subterranean formation; performing a propping cycle after the fracturing cycle comprising introducing the fracturing fluid with proppant particle into the wellbore to form a proppant pack in the at least one first fracture; performing a diversion cycle after the propping cycle comprising introducing the fracturing fluid with diverting agents into the wellbore to incorporate the diverting agent in the interstitial spaces of the proppant pack; performing an injection rate step cycle comprising introducing the fracturing fluid into the wellbore at a first injection rate ($IR_1$) and a second injection rate ($IR_2$), wherein the $IR_2$ and the $IR_3$ are non-zero, different, and less than the design fracturing injection rate; and repeating the fracturing cycle after the diversion cycle to create at least one second fracture in the subterranean formation.

Embodiment A may optionally include one or more of the following elements: Element 1: wherein the injection rate step cycle is an open low injection rate step cycle occurring after the fracturing cycle and before the propping cycle and the $IR_1$ and the $IR_2$ are about 1% to about 50% of the design fracturing injection rate; Element 2: Element 1 and wherein the method further comprises measuring wellbore pressures $P_1$ and $P_2$ at the $IR_1$ and the $IR_2$, respectively; and calculating $\Delta P_O=|P_1-P_2|$; Element 3: Element 2 and wherein the open low injection rate step cycle is a first open low injection rate step cycle and $\Delta P_O=\Delta P_{O,1}$, the propping cycle is a first propping cycle, the diversion cycle is a first diversion cycle, and the method further comprises: performing a second open low injection rate step cycle after the repeated fracturing cycle, wherein the second open low injection rate step cycle comprises introducing the fracturing fluid into the wellbore at a third injection rate ($IR_3$) and a fourth injection rate ($IR_4$), wherein the $IR_3$ and the $IR_4$ are non-zero, different, and about 1% to about 50% of the design fracturing injection rate; measuring wellbore pressures $P_3$ and $P_4$ at the $IR_3$ and the $IR_4$, respectively; calculating $\Delta P_{O,2}=|P_3-P_4|$; and performing a second propping cycle and a second diversion cycle, wherein a concentration of the diverting agent in the second diversion cycle is based on a comparison of $\Delta P_{O,1}$ and $\Delta P_{O,2}$ and a concentration of the diverting agent in the first diversion cycle; Element 4: Element 2 and wherein the open low injection rate step cycle is a first open low injection rate step cycle, the propping cycle is a first propping cycle, the diversion cycle is a first diversion cycle, the section of the wellbore is a first section of the wellbore, and the method further comprises: comparing the $\Delta P_O$ to a $\Delta P$ from a second open low injection rate step cycle previously performed in a second section of the wellbore; Element 5: Element 2 and wherein the open low injection rate step cycle is a first open low injection rate step cycle, the propping cycle is a first propping cycle, the diversion cycle is a first diversion cycle, the wellbore is a first wellbore, and the method further comprises: comparing the $\Delta P_O$ to a $\Delta P$ from a second open low injection rate step cycle previously performed in a second wellbore penetrating the subterranean formation; and performing a second propping cycle and a second diversion cycle, wherein a concentration of the diverting agent in the second diversion cycle is based on a comparison of the $\Delta P_O$ and the $\Delta P$ and a concentration of the diverting agent in the first diversion cycle; Element 6: wherein the injection rate step cycle is a propped low injection rate step cycle occurring during the propping cycle and the $IR_1$ and the $IR_2$ are about 1% to about 50% of the design fracturing injection rate; Element 7: wherein the injection rate step cycle is a diverted low injection rate step cycle occurring after the diversion cycle and before the repeated fracturing cycle and the $IR_1$ and the $IR_2$ are about 1% to about 50% of the design fracturing injection rate; Element 8: Element 7 and wherein the diversion cycle is a first diversion cycle and the injection rate step cycle is a first injection rate step cycle, and the method further comprises: performing a second injection rate step cycle that is a propped low injection rate step cycle occurring during the propping and comprising introducing the fracturing fluid into the wellbore at a third injection rate ($IR_3$) and a fourth injection rate ($IR_4$), wherein the $IR_3$ and the $IR_4$ are non-zero, different, and about 1% to about 50% of the design fracturing injection rate; measuring wellbore pressures $P_1$, $P_2$, $P_3$, and $P_4$ at the $IR_1$, the $IR_2$, the $IR_3$, and the $IR_4$ respectively; calculating $\Delta P_D=|P_1-P_2|$ and $\Delta P_P=|P_3-P_4|$; and when $\Delta P_P>\Delta P_D$ or $\Delta P_P\approx\Delta P_D$ performing a second diversion cycle after the diverted low injection rate step, wherein a concentration of the diverting agent in the second diversion cycle is greater than a concentration of the diverting agent in the first diversion cycle; Element 9: wherein the injection rate step cycle is a high injection rate step cycle and the $IR_1$ and the $IR_2$ are about 50% to about 100% of the design fracturing injection rate; and Element 10: wherein the injection rate step cycle is a high injection rate step cycle and the $IR_1$ and the $IR_2$ are about 1% to about 30% of the design fracturing injection rate. Exemplary combination of such elements may include, but are not limited to: Element 10 in combination with one or more of Elements 6-8; Element 10 in combination with Elements 1-2 and optionally in further combination with one or more of Elements 3-5; Elements 1-2 in combination with two or more of Elements 3-5; Element 6 and optionally Elements 10 in combination with Elements 1-2 and optionally in further combination with one or more of Elements 3-5; and Element 7 and optionally Elements 8 and/or 10 in combination with Elements 1-2 and optionally in further combination with one or more of Elements 3-5. To provide for the foregoing combinations, multiple injection rate step cycle may be performed.

Embodiment B is a method that comprises: (1) performing a first fracturing operation on a first section of a wellbore penetrating a subterranean formation with a series of cycles, wherein performing the fracturing operation comprises performing a plurality of series of cycles, wherein each of the series of cycles comprises: (A) performing a fracturing cycle on the first section of a wellbore, the fracturing cycle comprising introducing a fracturing fluid into a wellbore penetrating a subterranean formation at a design fracturing injection rate to create at least one first fracture in the subterranean formation; (B) performing a propping cycle after the fracturing cycle comprising introducing the fracturing fluid with proppant particle into the wellbore to form a proppant pack in the at least one first fracture; (C) performing a diversion cycle after the propping cycle comprising introducing the fracturing fluid with diverting agents into the wellbore to incorporate the diverting agent in the interstitial spaces of the proppant pack; (D) measuring a pressure change ($\Delta P_S$) associated with the diverting agents incorporating the diverting agent in the interstitial spaces of the proppant pack; (G) performing an injection rate step cycle comprising introducing the fracturing fluid into the wellbore at a first injection rate ($IR_1$) and a second injection rate ($IR_2$), wherein the $IR_2$ and the $IR_3$ are non-zero, different, and less than the design fracturing injection rate; (H) measuring wellbore pressures $P_1$ and $P_2$ at the $IR_2$ and the $IR_3$, respectively; and (I) calculating $\Delta P=|P_1-P_2|$; (2) determining an efficacy of each of the diversion cycles based on the $\Delta P_S$ for each of the series of cycles; (3) correlating the efficacy to an amount of diverting agents in the fracturing fluid to produce an efficacy-[DA] correlation; (4) correlating the ΔP to the [DA] based on the efficacy-[DA] correlation, thereby producing a ΔP-[DA] correlation; and (5) performing a second fracturing operation on a second section of the wellbore, wherein during a diversion cycle of the second fracturing operation a concentration of diverting agent used is based on the ΔP-[DA] correlation.

Embodiment B may optionally include one or more of the following elements: Element 11: wherein the injection rate step cycle is an open low injection rate step cycle occurring after the fracturing cycle and before the propping cycle and the $IR_1$ and the $IR_2$ are about 1% to about 50% of the design fracturing injection rate; Element 12: wherein the injection rate step cycle is a propped low injection rate step cycle occurring during the propping cycle and the $IR_1$ and the $IR_2$ are about 1% to about 50% of the design fracturing injection rate; Element 13: wherein the injection rate step cycle is a diverted low injection rate step cycle occurring after the diversion cycle and before the repeated fracturing cycle and the $IR_1$ and the $IR_2$ are about 1% to about 50% of the design fracturing injection rate; and Element 14: wherein the injection rate step cycle is a high injection rate step cycle and the $IR_1$ and the $IR_2$ are about 1% to about 30% of the design fracturing injection rate. Exemplary combination of such elements may include, but are not limited to: Element 11 in combination with one or more of Elements 12-13; Element 12 and 13 in combination; any of the foregoing in combination with Element 14; and Element 14 in combination with one or more of Elements 11-13. To provide for the foregoing combinations, multiple injection rate step cycle may be performed.

Embodiment C is a system that comprises: a tubular containing a fracturing fluid and extending into a wellbore penetrating a subterranean formation; a pump fluidly coupled to the tubular and configured for conveying the fracturing fluid through the tubular; a pressure sensor coupled to the tubular and configured for measuring a pressure of the fracturing fluid; and a processor communicably coupled to the pump and including a non-transitory, tangible, computer-readable storage medium: containing a program of instructions that cause a computer system running the program of instructions to: perform a fracturing cycle on a section of a wellbore, the fracturing cycle comprising introducing a fracturing fluid into a wellbore penetrating a subterranean formation at a design fracturing injection rate to create at least one first fracture in the subterranean formation; perform a propping cycle after the fracturing cycle comprising introducing the fracturing fluid with proppant particle into the wellbore to form a proppant pack in the at least one first fracture; perform a diversion cycle after the propping cycle comprising introducing the fracturing fluid with diverting agents into the wellbore to incorporate the diverting agent in the interstitial spaces of the proppant pack; perform an injection rate step cycle comprising introducing the fracturing fluid into the wellbore at a first injection rate ($IR_1$) and a second injection rate ($IR_2$), wherein the $IR_2$ and the $IR_3$ are non-zero, different, and less than the design fracturing injection rate; receive wellbore pressures $P_1$ and $P_2$ at the $IR_1$ and the $IR_2$, respectively, from the pressure sensor; calculate $\Delta P=|P_1-P_2|$; and repeat the fracturing cycle after the diversion cycle to create at least one second fracture in the subterranean formation. Embodiment C may optionally include one or more of Elements 11-14. Exemplary combination of such elements may include, but are not limited to: Element 11 in combination with one or more of Elements 12-13; Element 12 and 13 in combination; any of the foregoing in combination with Element 14; and Element 14 in combination with one or more of Elements 11-13. To provide for the foregoing combinations, the program of instructions may be configured to perform multiple injection rate step cycles.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments incorporating the invention embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

While compositions and methods are described herein in terms of "comprising" various components or steps, the compositions and methods can also "consist essentially of" or "consist of" the various components and steps.

To facilitate a better understanding of the embodiments of the present invention, the following examples of preferred or representative embodiments are given. In no way should the following examples be read to limit, or to define, the scope of the invention.

EXAMPLES

Figure 8:
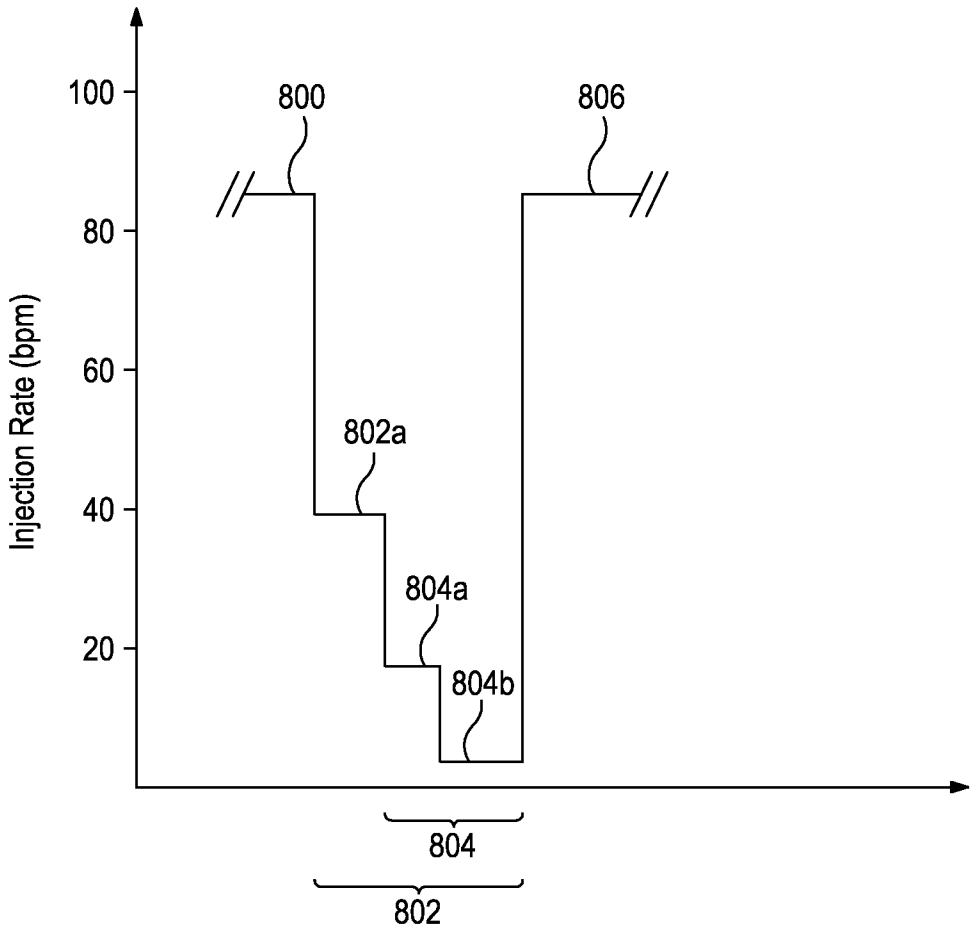
FIG. 8 illustrates a series of cycles used in an exemplary fracturing operation.

A fracturing operation using a series of cycles including IR step cycles was tested on an isolated section of an oil well in the Eagleford Shale. FIG. 8 illustrates the series of cycles used in Series A-C, which were performed sequentially. The series of cycles performed included a first fracture cycle 800 at an injection rate of about 80 barrels per minute (bpm) followed by a diversion cycle 802 that included a propped IR step cycle 804 and then a second fracture cycle 806 as illustrated in FIG. 8. In the diversion cycle 802, the diverting agent was added in a step 802*a* at an injection rate of about 40 bpm, a first step 804*a* of the propped IR step cycle 804 was performed at an injection rate of about 20 bpm, and a second step 804*b* of the propped IR step cycle 804 was performed at an injection rate of about 10 bpm.

Figure 9:
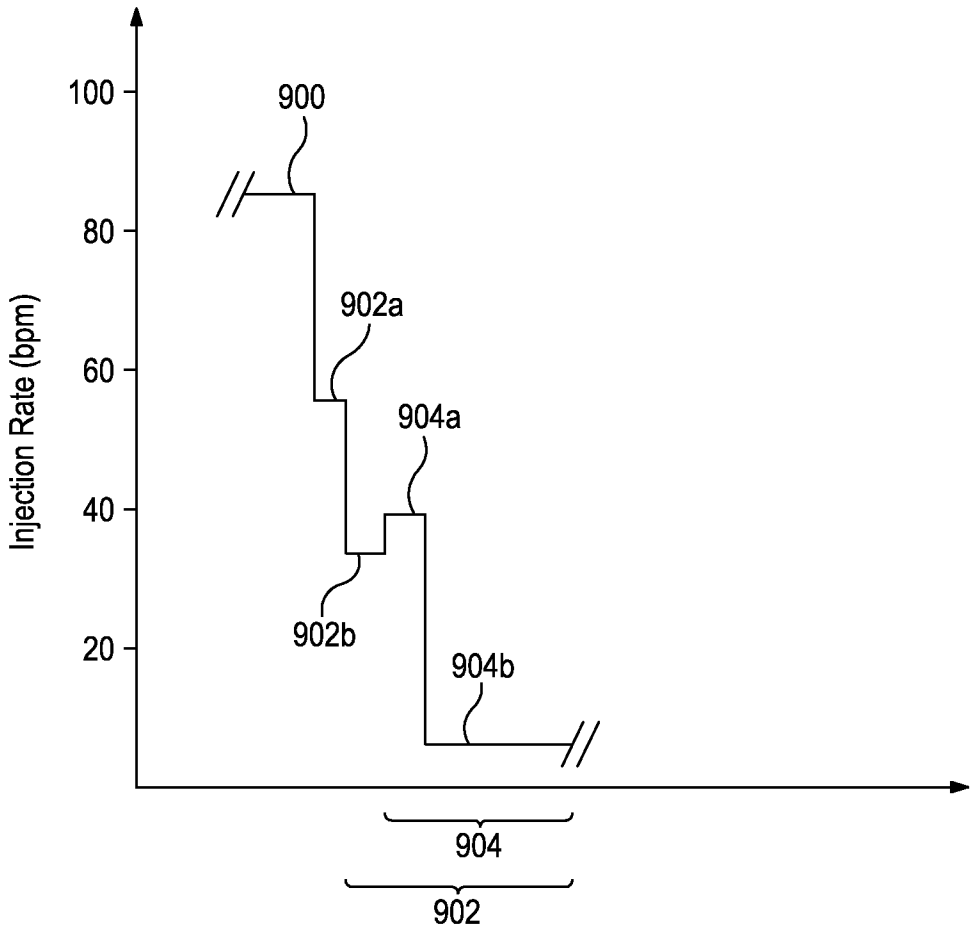
FIG. 9 illustrates an alternative series of cycles used in an exemplary fracturing operation.

FIG. 9 illustrates the series of cycles used in Series D, which was performed several series after Series C. Series D included a fracture cycle 900 at an injection rate of about 80 bpm and a diversion cycle 902, which included a first step 902*a* at 55 bpm, a second step 902*b* at 35 bpm, and a propped IR step cycle 904 having a first step 904*a* at 40 bpm and a second step 904*b* at 15 bpm. Diverting agent was dropped during the first and second steps 902*a*,902*b* of the diversion cycle 902.

Figure 10:
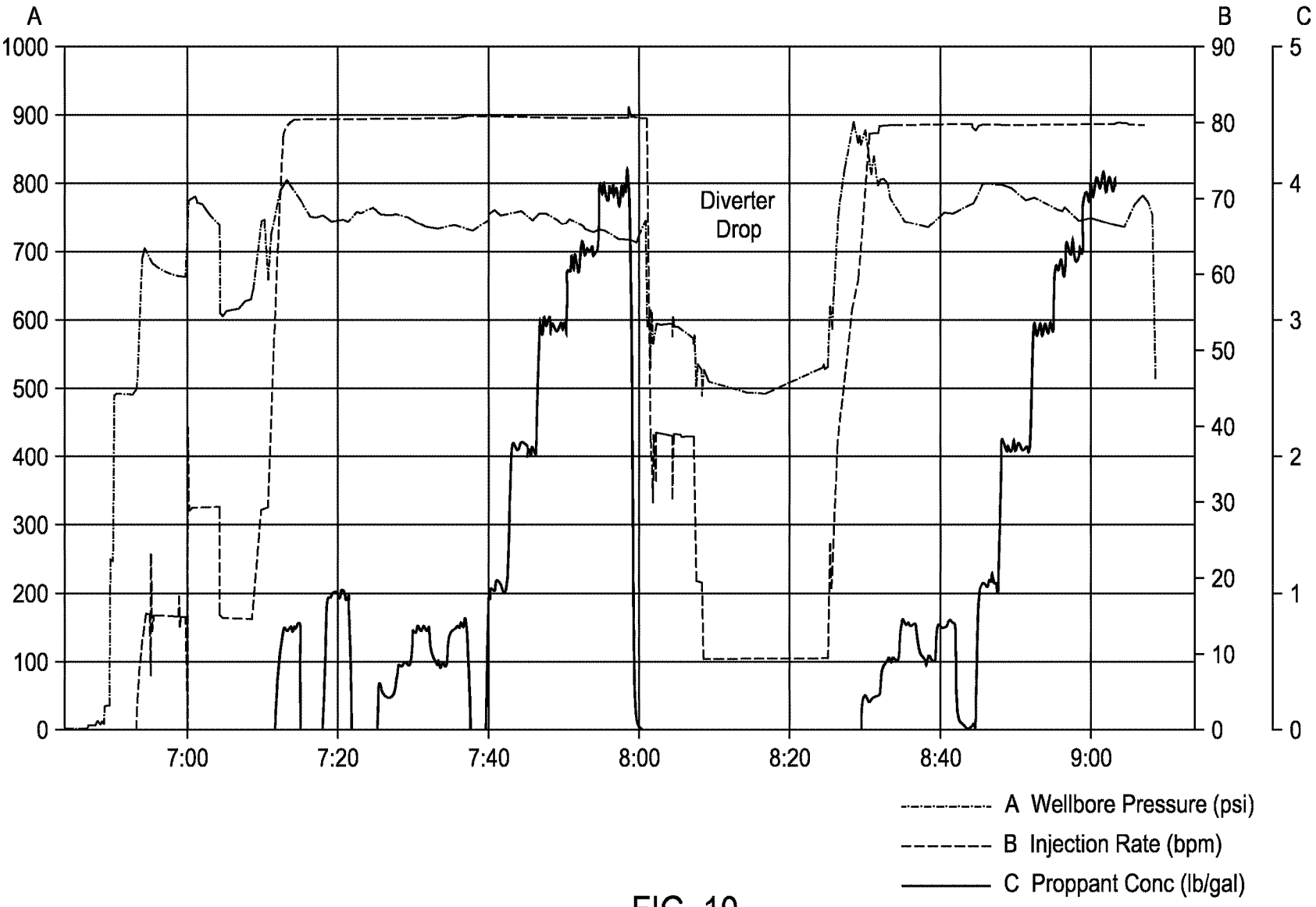
FIG. 10 provides a graph of the injection rate parameters and pressure data collected in an exemplary fracturing operation.

The pressure was monitored throughout each of the Series A-D where $P_x$ is the pressure at the portion of the series of cycles x of FIG. 8 or 9 (e.g., $P_{800}$ is the pressure at the first fracture cycle 800). During the second step 804*b*,904*b* of the propped IR step cycle 804,904, the diverting agent that was added reached the propped fractures and plugged at least some of the interstitial spaces thereof. Accordingly, the pressure increased during the second step 804*b*,904*b* of the propped IR step cycle 804,904, which is reported as $\Delta P_{804b}$ or $\Delta P_{904b}$ in Table 2. FIG. 10 provides a graph of the injection rate parameters and pressure data collected in Series A. $\Delta P_{904b}$ was a pressure spike indicating that too much diverting agent had been added, thereby completely plugging the propped fractures, which does not allow for extending the existing fractures.

TABLE 2

| Series | $P_{800}$ or $P_{900}$ | $P_{804a}$-$P_{804b}$ or $P_{904a}$-$P_{904b}$ | $\Delta P_{804b}$ or $\Delta P_{904b}$ | $P_{806}$ | amt of diverting agent added |
|---|---|---|---|---|---|
| A | 7500 psi | 200 psi | 450 psi | 7500 psi | 200 lb |
| B | 7500 psi | 250 psi | 750 psi | 8000 psi | 200 lb |
| C | 7500 psi | 300 psi | 750 psi | 7800 psi | 200 lb |
| D | 7500 psi | 500 psi * | pressure spike | n/a | 200 lb |

* $IR_{904a}$-$IR_{904b}$ = 25 bpm while $IR_{804a}$-$IR_{804b}$ = 10 bpm. 150 psi of the measured pressure was assumed to be from frictional forces because of the additional 15 bpm injection rate. The actual measurement was 650 psi.

The data collected in this example was used to develop a diverting agent guide in Table 3 for an operator to use in other sections of this wellbore or sections in other wellbores penetrating the same formation. In Series A, the $\Delta P_{804b}$ was about 450 psi and there was no change between $P_{800}$ and $P_{806}$, which indicates that an insufficient amount of diverting agent was added. Therefore, Table 3 suggests more diverting agent be added when the ΔP for a propped IR step cycle is about 200 psi. In Series B and C, the $\Delta P_{804b}$ was about 750 psi and there was an increase from $P_{800}$ to $P_{806}$ that was not too large, which indicates that the amount of diverting agent added was about right but that a bit more could have been added. Accordingly, Table 3 suggests such diverting agent concentration parameters when the ΔP for a propped IR step cycle is about 300 psi. Finally, at 500 psi for $P_{904a}$-$P_{904b}$ the pressure spiked when the diverting agent reached the propped fractures, which, as suggested in Table 3, means that a lower concentration of diverting agent should be used.

TABLE 3

| ΔP for a propped IR step cycle | amount of diverting agent |
|---|---|
| 200 psi | 200-400 lb |
| 300 psi | 175-300 lb |
| 400 psi | 150-200 lb |
| 500 psi | 100-150 lb |

This example illustrates that the pressure measurements during a series of cycles including IR step cycles in a fracturing operation may be used to develop operational parameters for the diverting agent concentration to be used in subsequent fracturing operations.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A method comprising:

performing a fracturing cycle on a section of a wellbore, the fracturing cycle comprising introducing a fracturing fluid into a wellbore penetrating a subterranean formation at a designed fracturing injection rate to create at least one first fracture in the subterranean formation;

performing a propping cycle after the fracturing cycle, wherein the propping cycle comprises introducing the fracturing fluid with proppant particle into the wellbore to form a proppant pack in the at least one first fracture;

performing a diversion cycle after the propping cycle, wherein the diversion cycle comprises introducing the fracturing fluid with diverting agents into the wellbore to incorporate the diverting agent in the interstitial spaces of the proppant pack;

performing an injection rate step cycle before or after the diversion cycle, wherein the injection rate step cycle comprises introducing the fracturing fluid into the wellbore at a first injection rate ($IR_1$) and a second injection rate ($IR_2$), wherein the $IR_1$ and the $IR_2$ are non-zero, different, and less than the designed fracturing injection rate; and repeating the fracturing cycle after the diversion cycle to create at least one second fracture in the subterranean formation.

2. The method of claim 1, wherein the injection rate step cycle is an open low injection rate step cycle occurring after the fracturing cycle and before the propping cycle and the $IR_1$ and the $IR_2$ are 1% to 50% of the designed fracturing injection rate.

3. The method of claim 2 further comprising:

measuring wellbore pressures $P_1$ and $P_2$ at the $IR_1$ and the $IR_2$, respectively; and calculating $\Delta P_O=|P_1-P_2|$, wherein $\Delta P_O$ is an open pressure change.

4. The method of claim 3, wherein the open low injection rate step cycle is a first open low injection rate step cycle and $\Delta P_O=\Delta P_{O,1}$, the propping cycle is a first propping cycle, wherein $\Delta P_{O,1}$ is an open pressure change for the first open low injection rate step cycle, the diversion cycle is a first diversion cycle, and the method further comprises:

performing a second open low injection rate step cycle after the repeated fracturing cycle, wherein the second open low injection rate step cycle comprises introducing the fracturing fluid into the wellbore at a third injection rate ($IR_3$) and a fourth injection rate ($IR_4$), wherein the $IR_3$ and the $IR_4$ are non-zero, different, and 1% to 50% of the designed fracturing injection rate;

measuring wellbore pressures $P_3$ and $P_4$ at the $IR_3$ and the $IR_4$, respectively;

calculating $\Delta P_{O,2}=|P_3-P_4|$, wherein $\Delta P_{O,2}$ is an open pressure change for the second open low injection rate step cycle; and performing a second propping cycle and a second diversion cycle, wherein a concentration of the diverting agent in the second diversion cycle is based on a comparison of $\Delta P_{O,1}$ and $\Delta P_{O,2}$ and a concentration of the diverting agent in the first diversion cycle.

5. The method of claim 3, wherein the open low injection rate step cycle is a first open low injection rate step cycle, the propping cycle is a first propping cycle, the diversion cycle is a first diversion cycle, the section of the wellbore is a first section of the wellbore, and the method further comprises:

comparing the $\Delta P_O$ to a $\Delta P$ from a second open low injection rate step cycle previously performed in a second section of the wellbore, wherein $\Delta P$ is a pressure change.

6. The method of claim 3, wherein the open low injection rate step cycle is a first open low injection rate step cycle, the propping cycle is a first propping cycle, the diversion cycle is a first diversion cycle, the wellbore is a first wellbore, and the method further comprises:

comparing the $\Delta P_O$ to a $\Delta P$ from a second open low injection rate step cycle previously performed in a second wellbore penetrating the subterranean formation, wherein $\Delta P$ is a pressure change; and performing a second propping cycle and a second diversion cycle, wherein a concentration of the diverting agent in the second diversion cycle is based on a comparison of the $\Delta P_O$ and the $\Delta P$ and a concentration of the diverting agent in the first diversion cycle.

7. The method of claim 1, wherein the injection rate step cycle is a propped low injection rate step cycle occurring during the propping cycle and the $IR_1$ and the $IR_2$ are 1% to 50% of the designed fracturing injection rate.

8. The method of claim 1, wherein the injection rate step cycle is a diverted low injection rate step cycle occurring after the diversion cycle and before the repeated fracturing cycle and the $IR_1$ and the $IR_2$ are 1% to 50% of the designed fracturing injection rate.

9. The method of claim 8, wherein the diversion cycle is a first diversion cycle and the injection rate step cycle is a first injection rate step cycle, and the method further comprises:

performing a second injection rate step cycle that is a propped low injection rate step cycle occurring during the propping and comprising introducing the fracturing fluid into the wellbore at a third injection rate ($IR_3$) and a fourth injection rate ($IR_4$), wherein the $IR_3$ and the $IR_4$ are non-zero, different, and 1% to 50% of the designed fracturing injection rate;

measuring wellbore pressures $P_1$, $P_2$, $P_3$, and $P_4$ at the $IR_1$, the $IR_2$, the $IR_3$, and the $IR_4$ respectively;

calculating $\Delta P_D=|P_1-P_2|$ and $\Delta P_P=|P_3-P_4|$, wherein $\Delta P_D$ is a diverted pressure change, wherein $\Delta P_P$ is a propped pressure change; and when $\Delta P_P>\Delta P_D$ or $\Delta P_P\approx\Delta P_D$ performing a second diversion cycle after the diverted low injection rate step, wherein a concentration of the diverting agent in the second diversion cycle is greater than a concentration of the diverting agent in the first diversion cycle.

10. The method of claim 1, wherein the injection rate step cycle is a high injection rate step cycle and the $IR_1$ and the $IR_2$ are 50% to 100% of the designed fracturing injection rate.

11. A method comprising:

(1) performing a first fracturing operation on a first section of a wellbore penetrating a subterranean formation with a series of cycles, wherein performing the fracturing operation comprises performing a plurality of series of cycles, wherein each of the series of cycles comprises:

(A) performing a fracturing cycle on the first section of a wellbore, the fracturing cycle comprising introducing a fracturing fluid into a wellbore penetrating a subterranean formation at a designed fracturing injection rate to create at least one first fracture in the subterranean formation;

(B) performing a propping cycle after the fracturing cycle, wherein the propping cycle comprises introducing the fracturing fluid with proppant particle into the wellbore to form a proppant pack in the at least one first fracture;

(C) performing a diversion cycle after the propping cycle, wherein the diversion cycle comprises introducing the fracturing fluid with diverting agents into the wellbore to incorporate the diverting agent in the interstitial spaces of the proppant pack;

(D) measuring a pressure change ($\Delta P_S$) associated with the diverting agents incorporating the diverting agent in the interstitial spaces of the proppant pack, wherein $\Delta P_S$ is an increase in pressure due to seating of the diverting agent;

(G) performing an injection rate step cycle before or after the diversion cycle, wherein preforming an injection rate step cycle comprises introducing the fracturing fluid into the wellbore at a first injection rate ($IR_1$) and a second injection rate ($IR_2$), wherein the $IR_1$ and the $IR_2$ are non-zero, different, and less than the designed fracturing injection rate;

(H) measuring wellbore pressures $P_1$ and $P_2$ at the $IR_1$ and the $IR_2$, respectively; and (I) calculating $\Delta P=|P_1-P_2|$, wherein $\Delta P$ is a change in pressure;

(2) determining an efficacy of each of the diversion cycles based on the $\Delta P_S$ for each of the series of cycles;

(3) correlating the efficacy to an amount of diverting agents in the fracturing fluid to produce an efficacy-[DA] correlation, wherein [DA] is the diverting agent concentration;

(4) correlating the ΔP to the [DA] based on the efficacy-[DA] correlation, thereby producing a ΔP-[DA] correlation; and (5) performing a second fracturing operation on a second section of the wellbore, wherein during a diversion cycle of the second fracturing operation a concentration of diverting agent used is based on the ΔP-[DA] correlation.

12. The method of claim 11, wherein the injection rate step cycle is an open low injection rate step cycle occurring after the fracturing cycle and before the propping cycle and the $IR_1$ and the $IR_2$ are 1% to 50% of the designed fracturing injection rate.

13. The method of claim 11, wherein the injection rate step cycle is a propped low injection rate step cycle occurring during the propping cycle and the $IR_1$ and the $IR_2$ are 1% to 50% of the designed fracturing injection rate.

14. The method of claim 11, wherein the injection rate step cycle is a diverted low injection rate step cycle occurring after the diversion cycle and before the repeated fracturing cycle and the $IR_1$ and the $IR_2$ are 1% to 50% of the designed fracturing injection rate.

15. A system comprising:

a tubular containing a fracturing fluid and extending into a wellbore penetrating a subterranean formation;

a pump fluidly coupled to the tubular and configured for conveying the fracturing fluid through the tubular;

a pressure sensor coupled to the tubular and configured for measuring a pressure of the fracturing fluid; and a processor communicably coupled to the pump and including a non-transitory, tangible, computer-readable storage medium: containing a program of instructions that cause a computer system running the program of instructions to:

perform a fracturing cycle on a section of a wellbore, the fracturing cycle comprising introducing a fracturing fluid into a wellbore penetrating a subterranean formation at a designed fracturing injection rate to create at least one first fracture in the subterranean formation;

perform a propping cycle after the fracturing cycle, wherein the propping cycle comprises introducing the fracturing fluid with proppant particle into the wellbore to form a proppant pack in the at least one first fracture;

perform a diversion cycle after the propping cycle, wherein the diversion cycle comprises introducing the fracturing fluid with diverting agents into the wellbore to incorporate the diverting agent in the interstitial spaces of the proppant pack;

perform an injection rate step cycle before or after the diversion cycle, wherein the injection rate step cycle comprises introducing the fracturing fluid into the wellbore at a first injection rate ($IR_1$) and a second injection rate ($IR_2$), wherein the $IR_1$ and the $IR_2$ are non-zero, different, and less than the designed fracturing injection rate;

receive wellbore pressures $P_1$ and $P_2$ at the $IR_1$ and the $IR_2$, respectively, from the pressure sensor;

calculate $\Delta P=|P_1-P_2|$, wherein ΔP is a change in pressure; and repeat the fracturing cycle after the diversion cycle to create at least one second fracture in the subterranean formation.

16. The system of claim 15, wherein the injection rate step cycle is an open low injection rate step cycle occurring after the fracturing cycle and before the propping cycle and the $IR_1$ and the $IR_2$ are 1% to 50% of the designed fracturing injection rate.

17. The system of claim 15, wherein the injection rate step cycle is a propped low injection rate step cycle occurring during the propping cycle and the $IR_1$ and the $IR_2$ are 1% to 50% of the designed fracturing injection rate.

18. The system of claim 15, wherein the injection rate step cycle is a diverted low injection rate step cycle occurring after the diversion cycle and before the repeated fracturing cycle and the $IR_1$ and the $IR_2$ are 1% to 50% of the designed fracturing injection rate.

* * * * *